US010357110B2

(12) United States Patent
Potrykus et al.

(10) Patent No.: US 10,357,110 B2
(45) Date of Patent: Jul. 23, 2019

(54) CHAIR, IN PARTICULAR OFFICE CHAIR

(71) Applicant: BOCK 1 GMBH & CO. KG, Postbauer-Heng (DE)

(72) Inventors: Martin Potrykus, Bamberg (DE); Armin Sander, Fuerth (DE)

(73) Assignee: BOCK 1 GmbH & Co. KG, Postbauer-Heng (DE)

( * ) Notice: Subject to any disclaimer, the term of this patent is extended or adjusted under 35 U.S.C. 154(b) by 257 days.

(21) Appl. No.: 15/126,029

(22) PCT Filed: Mar. 4, 2015

(86) PCT No.: PCT/EP2015/000487

§ 371 (c)(1),
(2) Date: Sep. 14, 2016

(87) PCT Pub. No.: WO2015/135632

PCT Pub. Date: Sep. 17, 2015

(65) Prior Publication Data

US 2017/0099951 A1 Apr. 13, 2017

(30) Foreign Application Priority Data

Mar. 14, 2014 (DE) ..... 10 2014 003 676

(51) Int. Cl.

| | |
|---|---|
| ***A47C 7/42*** | (2006.01) |
| ***A47C 7/54*** | (2006.01) |
| ***A47C 1/032*** | (2006.01) |
| ***A47C 4/02*** | (2006.01) |

(52) U.S. Cl.

CPC ..... *A47C 7/42* (2013.01); *A47C 1/032* (2013.01); *A47C 4/02* (2013.01); *A47C 7/546* (2013.01)

(58) Field of Classification Search

CPC .. A47C 7/42; A47C 1/032; A47C 4/02; A47C 7/546

USPC ..... 297/340, 411.2, 440.21, 440.15, 452.11, 297/440.16

See application file for complete search history.

(56) References Cited

U.S. PATENT DOCUMENTS

| | | | | |
|---|---|---|---|---|
| 5,619,745 | A | 4/1997 | Kobayashi | |
| 5,709,057 | A | 1/1998 | Johnson, Jr. et al. | |
| 6,059,238 | A * | 5/2000 | Reynolds | B60N 2/75 248/118 |
| 2011/0068613 | A1* | 3/2011 | Breitkreuz | A47C 7/42 297/440.15 |

(Continued)

FOREIGN PATENT DOCUMENTS

| | | | |
|---|---|---|---|
| DE | 29510446 | U1 | 11/1995 |
| DE | 4422106 | A1 | 1/1996 |

(Continued)

*Primary Examiner* — Syed A Islam

(74) *Attorney, Agent, or Firm* — Laurence A. Greenberg; Werner H. Stemer; Ralph E. Locher

(57) ABSTRACT

A chair, in particular an office chair, has a backrest which is coupled to a seat support by way of a backrest support. The chair further has a seat face. For tool-free chair assembly the backrest support is constructed in two pieces having a first support member which is associated with the seat support and having a second support member which is associated with the backrest and which is joined to the seat-support-side first support member in a positive-locking plug type connection and is locked therein.

17 Claims, 7 Drawing Sheets

(56) References Cited

U.S. PATENT DOCUMENTS

| | | | | |
|---|---|---|---|---|
| 2011/0074197 | A1* | 3/2011 | Okamoto | A47C 1/03238 297/300.6 |
| 2011/0140498 | A1 | 6/2011 | Tsai | |
| 2013/0017013 | A1 | 1/2013 | Hale | |

FOREIGN PATENT DOCUMENTS

| | | | |
|---|---|---|---|
| DE | 10122945 | A1 | 12/2002 |
| DE | 10312446 | B3 | 8/2004 |
| DE | 202005017321 | U1 | 12/2006 |
| DE | 202010014557 | U1 | 12/2010 |
| DE | 102009041822 | A1 | 3/2011 |
| GB | 2356805 | A | 6/2001 |
| GB | 2478823 | A | 9/2011 |
| WO | 2005053464 | A1 | 6/2005 |

* cited by examiner

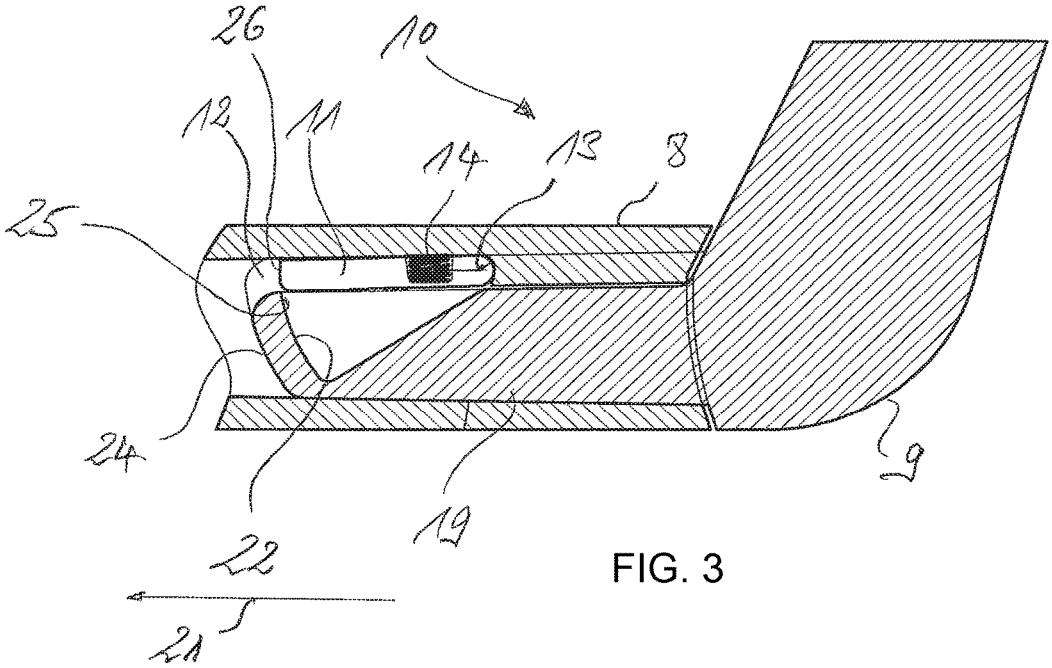
FIG. 3
FIG. 4
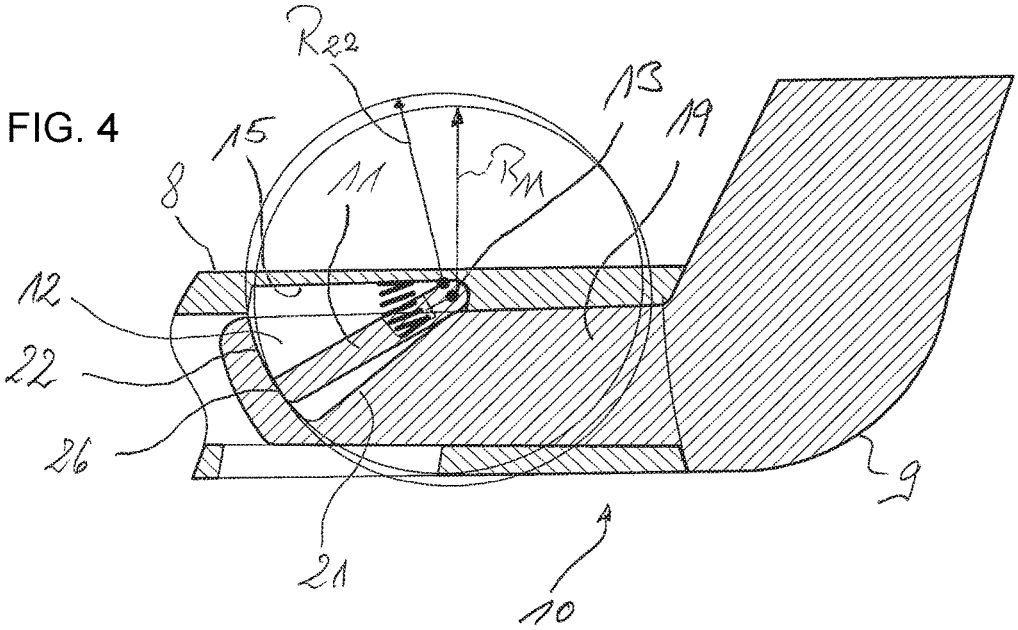

CHAIR, IN PARTICULAR OFFICE CHAIR

BACKGROUND OF THE INVENTION

Field of the Invention

The invention relates to a chair, in particular an office chair, having a backrest which is coupled to a seat support by means of a backrest support and having a seat face and optionally having two armrests.

A modern office chair, such as a chair known, for example, from DE 20 2005 017 321 U1 and DE 101 22 945 A1, generally comprises a seat support which rests on a chair column and to which a backrest support for a backrest is mechanically coupled so as to be pivotably movable. A corresponding, in particular resiliently loaded, pivot mechanism enables the backrest to be inclined to the rear counter to an, for example, adjustable spring restoring force. Armrests which may be provided are therefore generally connected to the backrest support in order to carry out an inclination movement together with the backrest.

Such an office chair can further generally be adjusted in terms of height by means of corresponding construction of the chair column and can be readily displaced by means of rollers which are retained on extension arms which are arranged in the manner of a star. Such an office chair is often also provided with a synchronization mechanism which enables a synchronous movement of the seat face with the backrest.

BRIEF SUMMARY OF THE INVENTION

An object of the invention is to construct such an office chair so as to be able to be assembled in such a manner that it can be transported and/or stored in a space-saving manner.

This object is achieved according to the invention by the features of claim 1. The dependent claims relate to advantageous embodiments and developments.

To this end, the chair according to the invention, in particular an office chair, is constructed so as to be able to be assembled without tools, in a particularly preferable manner by the backrest support being constructed in two pieces with there being formed second support members which during the assembly operation are inserted in a positive-locking plug type connection and are locked therein. Additionally or alternatively, armrests which may be present may also be inserted in a corresponding positive-locking plug type connection with the backrest support and locked in this plug type connection.

With regard to the joining or plug type connection of the two-piece backrest support, this is formed by a first support member which is associated with the seat support and a second support member which is associated with the backrest, wherein the backrest-side (second) support member is locked to the seat-support-side (first) support member in the positive-locking plug type connection during the joining operation. To this end, one of the support members has in a suitable manner at the joint side a shaft-like or bush-like plug type receiving member and the other support member has a corresponding insertion shaft at the joint side.

The locking of the two support members to each other is carried out in an advantageous embodiment by means of a locking bar, which is arranged in a rotationally movable manner inside the plug type receiving member and in this instance, preferably in the insertion direction of the insertion shaft of the corresponding support member, is arranged so as to be pivotably movable. Alternatively, there may be provided a locking hook which is then arranged so as to be pivotably movable in the plug type receiving member counter to the insertion direction of the insertion shaft.

In order to increase the force with which the locking bar pivots into the locking position thereof during the plug type or joining connection operation, there is advantageously provided a mechanical resilient element, in particular in the form of a helical, conical or coil spring which acts as a pressure spring. This resilient element is supported inside the plug type receiving member of the corresponding support member, on the one hand, on the inner wall thereof and, on the other hand, on the locking bar.

During the insertion operation, in which the locking bar is pivoted by means of the free end of the insertion shaft, the resilient element is tensioned. As soon as the insertion shaft of the corresponding support member has reached a specific desired position within the plug type receiving member of the other support member, the locking bar—where applicable supported by the restoring force of the resilient element—pivots into an insertion-shaft-side locking contour. A stepped contour or a fold which is associated with the plug type receiving member at the inner side enables complete pivoting outwards of the locking bar during the plug type connection so that the insertion shaft with the free end thereof and the shaft portion thereof which has the locking contour can pass the locking bar which is pivoted inwards against the inner wall of the plug type receiving member in an unimpeded manner.

For the most low-friction possible pivoting of the locking bar against the inner wall of the plug type receiving member, the insertion shaft of the corresponding support member has a convex outer contour at the free end side.

According to an advantageous embodiment, there is constructed along the locking contour of the insertion shaft a locking ramp along which the locking bar slides during the plug type connection with the free-end-side end face thereof into the locking end position. A suitable development makes provision for there to be constructed along the locking contour an abutment ramp which runs obliquely into a ramp base and against which the locking bar pivots out during the locking operation. The locking ramp of the locking contour also runs into this ramp base.

The locking contour is in this instance constructed in such a manner that the locking bar during the pivot movement thereof into the locking end position draws the insertion shaft into the plug type receiving member in the insertion direction. This effect of self-drawing of the support member having the insertion shaft into the plug type receiving member of the other support member is achieved by means of a corresponding configuration of the locking ramp by it conforming to the pivot radius of the locking bar as the ramp depth increases. This effect with the correspondingly controlled pivoting of the locking bar into the locking end position thereof is supported by the resilient element, wherein relative movements which are carried out manually between the two support members result in movements of the support member which has the insertion shaft in the insertion direction until the locking bar has reached its locking end position.

When armrests are present, these are suitably joined to the armrest support by means of a corresponding plug type connection including locking during a manual assembly operation. In this instance, the armrest support may have a corresponding plug type receiving member whilst the respective armrest portion has a corresponding insertion shaft.

In an advantageous development, the backrest may be coupled to the seat support in a pivotably movable manner and the seat face may additionally be coupled to the seat support in a suitable manner so as to be able to be moved synchronously with the backrest.

The advantages achieved with the invention in particular involve the fact that, using such a positive-locking plug type connection of a two-piece backrest support, the backrest of a chair, preferably an office chair, can be mounted manually in a simple manner on a seat support without the use of tools, wherein the plug type connection between the two corresponding support members locks independently. A corresponding tool-free assembly of armrests which may be present using a corresponding plug type connection including locking enables a time-saving and particularly simple-to-handle assembly of a chair which is delivered in corresponding individual pieces without any need to provide conventional or special tools.

Although a corresponding plug type connection with a non-releasable locking already appears to be advantageous with respect to a space-saving transport and/or storage possibility of such an office chair which is provided in a few individual pieces, the locking of the plug type connection can suitably be released. To this end, an access opening to the locking bar is advantageously introduced into the plug type receiving member at the side of the plug type receiving member of the corresponding support member, which side is opposite the rotation axis of the locking bar. The access to the locking bar via the insertion shaft side facing the receiving-member-side plug type opening inside the plug type connection is suitably carried out by means of a corresponding, preferably significantly smaller unlocking opening inside the insertion shaft and at that location in the region of the locking contour, in particular in the region of the abutment ramp thereof, against which the locking bar is in abutment in the locking end position thereof.

BRIEF DESCRIPTION OF THE SEVERAL VIEWS OF THE DRAWING

Embodiments of the invention are explained in greater detail below with reference to the drawings, in which:

FIG. 3 is a view according to FIG. 2 of the plug type connection of the support members of the backrest support in the insertion position without any locking, FIG. 4 is a view according to FIGS. 1 and 2 of the locked plug type connection of the two support members with the locking bar which is pivoted into the locking position.

Components which correspond to each other are given the same reference numerals in all the Figures.

DESCRIPTION OF THE INVENTION

Figure 1:
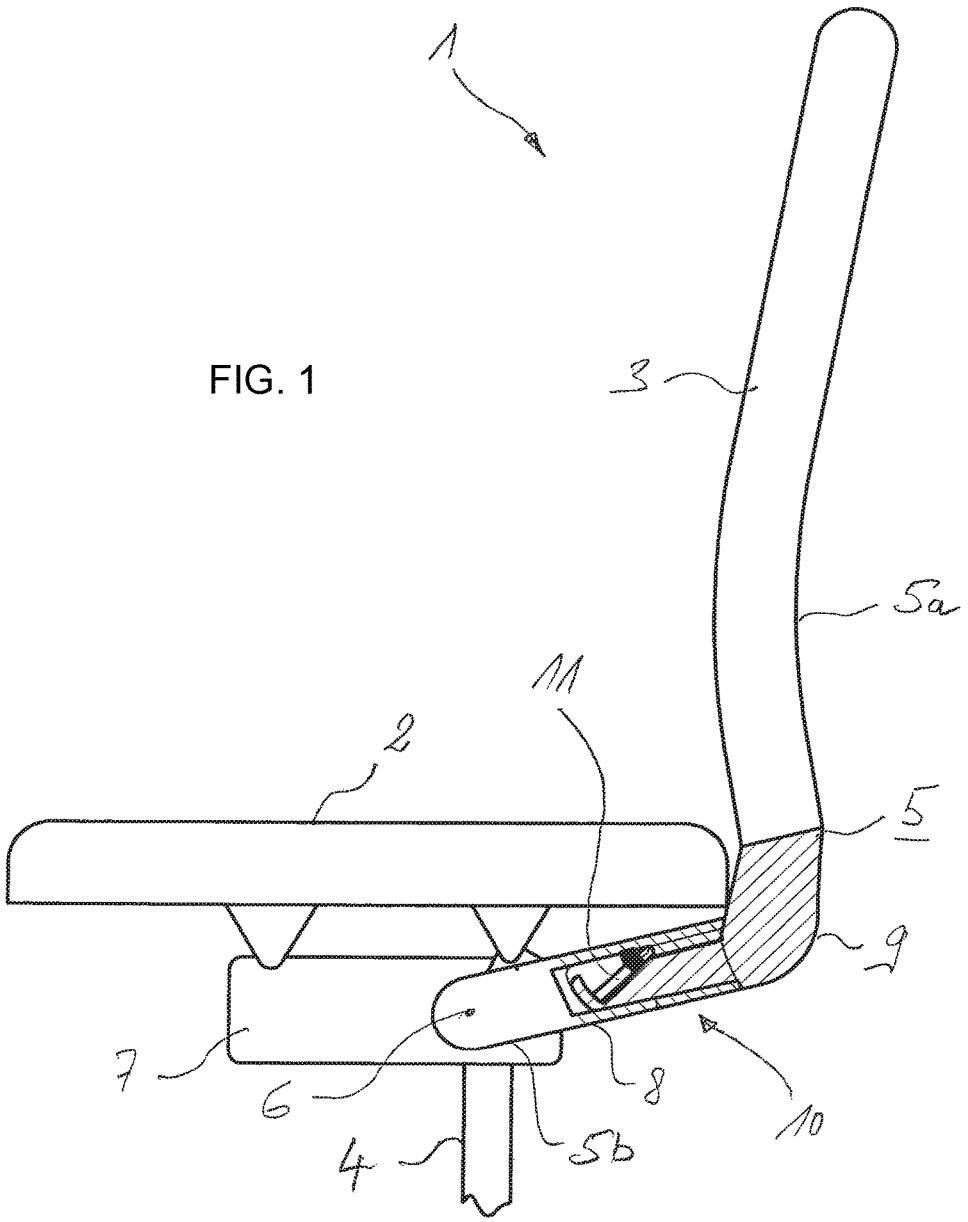
FIG. 1 is a schematic side view of an office chair with joined support members of a backrest support.

FIG. 1 is a schematic side view of an office chair 1. The office chair 1 has a seat or a seat face 2 and a backrest 3 and is supported by means of a chair column 4 by a foot frame which is not shown. The office chair 1 may further have armrests which are not shown and which form a functional unit with the backrest 3.

A backrest support 5 which supports the backrest 3 and to which the armrests are where applicable secured so as to be able to be inserted and locked can be pivoted by means of a rotary bearing 6, that is to say, mounted on a seat support 7 so as to be able to be inclined backwards. Between the backrest support 5 and the seat support 7 there may be provided in a manner not shown in greater detail a synchronization mechanism which enables a synchronous movement of the seat face 2 during an inclination of the backrest 3 in a backward direction.

The backrest support 5 is substantially or approximately L-shaped with a vertical L-shaped member 5*a* and an L-shaped member 5*b* which extends in a substantially horizontal manner below the seat face 2. In the shaded partially sectioned transition region of the two L-shaped members 5*a*, 5*b*, the backrest support 5 is constructed in two pieces with a seat-support-side (first) support member 8 and a backrest-side (second) support member 9 being formed. The two support members 8, 9 are joined in a positive-locking plug type connection 10 and locked therein by means of a locking bar 11.

Figure 2:
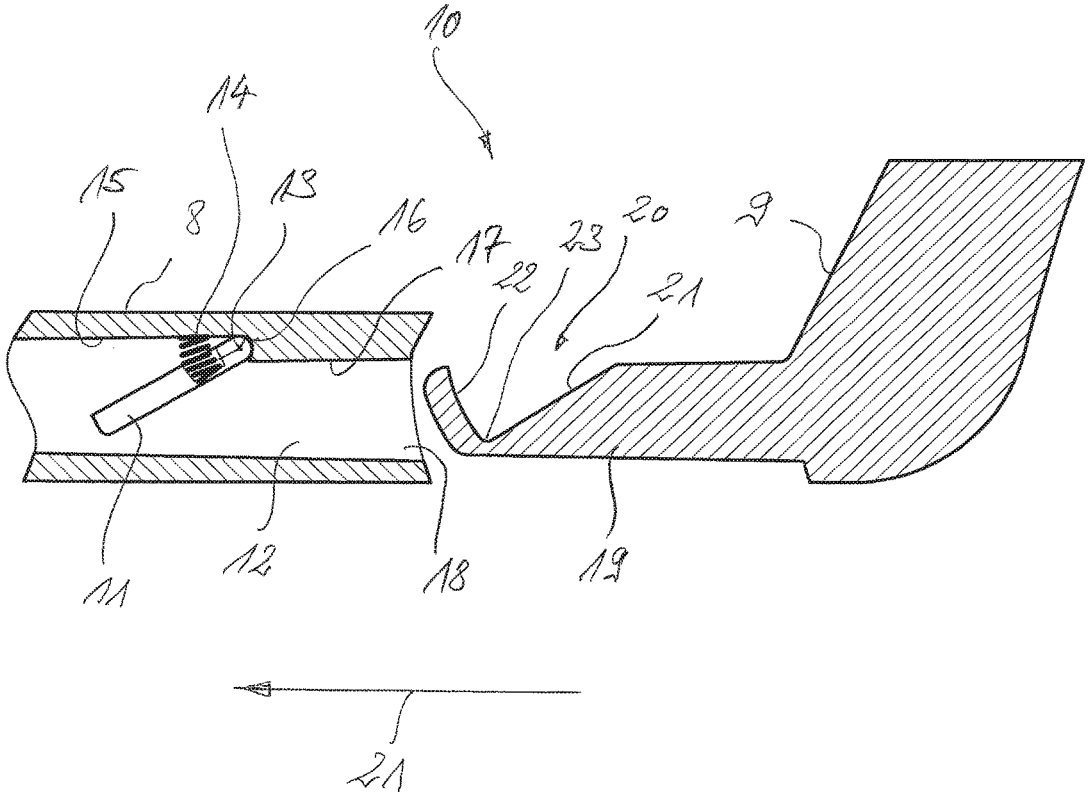
FIG. 2 is a cutout of the two-piece backrest support in a pre-insertion position.

As shown in FIGS. 2 to 4 as an enlarged cutout of the region of the plug type connection 10 between the two support members 8 and 9, the seat-support-side support member 8 has a plug type receiving member 12 in which the locking bar 11 is arranged with the articulation end thereof in a rotary bearing 13 so as to be pivotably movable. A resilient element 14 is also arranged inside the plug type receiving member 12 and is supported at that location on the one hand on an inner wall 15 of the plug type receiving member 12, which inner wall faces the seat face 2 and, on the other hand, on the locking bar 11. The locking bar 11 is located with the articulation end thereof in the region of a stepped contour 16 within the plug type receiving member 12 in such a manner that the locking bar 11 in the inwardly pivoted state shown in FIG. 3 is in alignment with an insertion wall 17 between an insertion opening 18 and the rotary bearing 13. That is to say, the inwardly pivoted locking bar 11 completely releases the plug type receiving member 12, that is to say, a corresponding insertion channel inside the plug type receiving member 12 of the seat-support-side support member 8.

The backrest-side support member 9 of the backrest support 5 has at the joint side an insertion shaft 19 whose outer diameter is adapted to the clear width of the plug type receiving member 12 of the backrest-side support member 8 in order to produce a positive-locking connection in the plug type connection 10. Inside the insertion shaft 19, there are provided at the side thereof facing the locking bar 11 a locking contour 20 with an abutment ramp 21 which extends obliquely, that is to say, which declines in an oblique manner in the insertion direction 21, and a locking ramp 22 which merges with the abutment ramp 21 in the region of a ramp base 23. The locking ramp 22 rises in the insertion direction 21 in a suitable manner in a circular manner or declines counter to the insertion direction 21 shown towards the ramp base 23.

During the production of the plug type connection 10 between the two support members 8, 9 of the two-piece backrest support 5, the insertion shaft 19 moves inside the plug type receiving member 12 into abutting contact with the locking bar 11. As a result, the locking bar 11 is pivoted into the pivoted-in position thereof shown in FIG. 3. To this end, the insertion shaft 19 is provided at the free end side with a concave outer contour 24. As soon as the insertion shaft 19 has completely passed the locking bar 11 with the locking contour 20 thereof and in this instance the ramp end 25 of the locking ramp 22, which end is applied to the ramp base 23, has passed the free end 26 of the locking bar 11, the locking bar 11 falls into the wedge-like locking contour 20 of the insertion shaft 19. During this pivot movement of the locking bar 11, it slides with the free end 26 thereof along the locking ramp 22. In this instance, it conforms to the pivot radius of the locking bar 11 as the ramp depth increases in the direction of the ramp base 23.

In addition, the insertion shaft 19 is increasingly drawn in the insertion direction 21 into the corresponding plug type receiving member 12 of the corresponding support member 8. In this instance, the locking contour 20 and in particular the path of the locking ramp 22 is constructed in such a manner that the locking bar 11 during its pivot movement into the locking end position draws the insertion shaft 19 into the plug type receiving member 12 in the insertion direction 21. This effect of self-drawing of the support member 9 which has the insertion shaft 19 into the plug type receiving member 12 of the other support member 8 is achieved by means of a corresponding circular configuration of the locking ramp 22 by it conforming to the pivot radius $R_{11}$ of the locking bar 11 as the ramp depth increases. The circle which is associated with the pivot radius $R_{11}$ of the locking bar 11 and the circle which is associated with the circle of the circular locking ramp 22 with the radius of curvature $R_{22}$ are illustrated in FIG. 4. It is possible to see the circle centre points of the circles with the radii $R_{11}$ and $R_{22}$ spaced apart from each other with the result described that the insertion shaft 19 while the free end 26 of the locking bar 11 slides along the locking ramp 22, the insertion shaft 19 of the support member 9 is increasingly drawn into the corresponding plug type receiving member 12 of the support member 8. This effect with a correspondingly controlled pivoting of the locking bar 11 is supported by the resilient element 14. In this instance, relative movements between the two support members 8, 9 result in movements of the support member 9 which has the insertion shaft 19 in the insertion direction 21 until the locking bar 11 has reached its locking end position.

Figure 5:
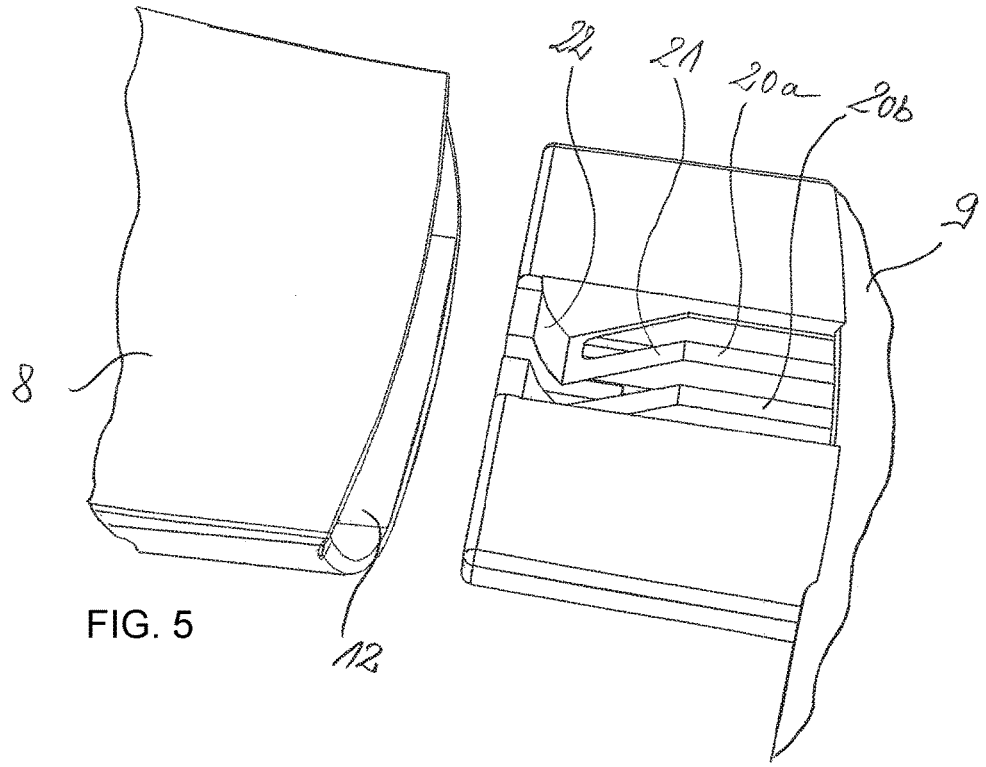
FIG. 5 is a perspective partial view of a structural embodiment of the backrest support in the pre-insertion position of the insertion shaft of the backrest-side support member in front of the plug type receiving member of the seat-support-side support member.
Figure 6:
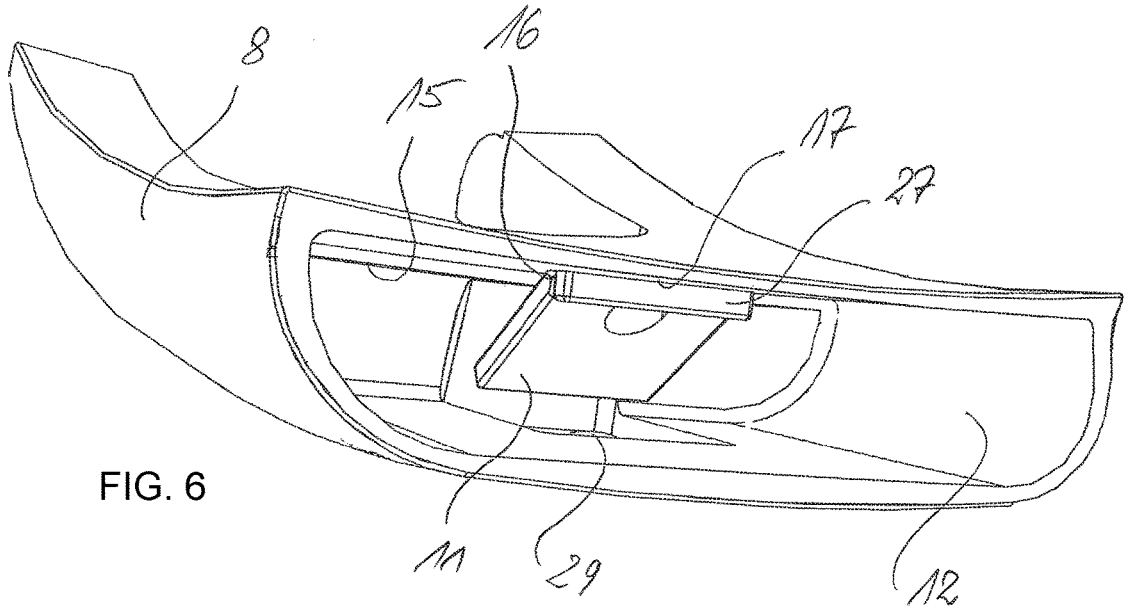
FIG. 6 is a perspective cutout of the embodiment according to FIG. 5 when viewed in the plug type receiving member of the seat-support-side support member.
Figure 7:
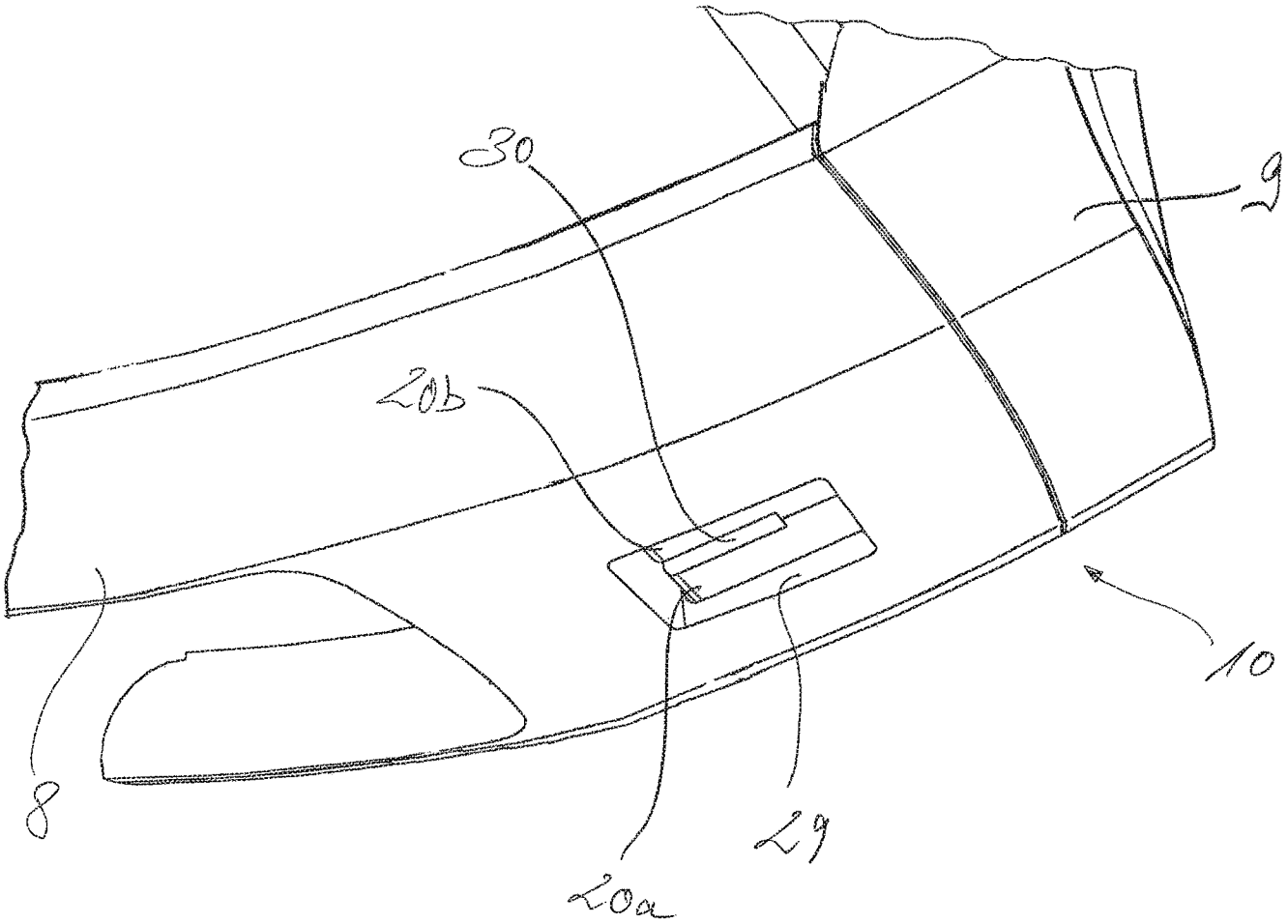
FIG. 7 is a perspective cutout of the embodiment according to FIG. 5 with a backrest support which is connected and locked when viewed from below in the direction towards an unlocking opening in the seat-support-side support member.

FIGS. 5 to 7 show a specific structural configuration of the two-piece backrest support 5 with the seat-support-side support member 8 and the backrest-side support member 9 thereof in a preliminary position of the plug type connection 10 between the insertion shaft 19 and the plug type receiving member 12 of the respective support member 9 or 8, respectively. It is possible to see the locking contour 20 in the embodiment, for example, formed by two struts 20*a*, 20*b* which are spaced apart from each other and on which the abutment ramp 21 and the locking ramp 22 are formed.

FIG. 6 is a view into the plug type receiving member 12 of the seat-support-side support member 8. It is possible to see the in this instance plate-like locking bar 11 shown in the pivoted-out position thereof according to FIG. 2. The stepped contour 16, behind which the locking bar 11 during the production of the plug type connection 10 pivots in against the inner wall 15 of the plug type receiving member 12, is provided in this instance by a rod-like or strut-like formed element 27 which is formed on the corresponding inner wall 15 of the plug type receiving member 12 of the seat-support-side support member 8. In the inner wall 28 of the plug type receiving member 12, which wall is opposite this inner wall 15 and the insertion wall 17, there is introduced an access opening 29 for a tool by means of which the plug type connection 10 between the two support members 8 and 9 of the backrest support 5 can be unlocked.

In the locked plug type connection 10 shown in FIG. 7 between the two support members 8 and 9 of the backrest support 5, the insertion shaft 19 is accessible in the region of the web-like construction of the locking contour 20 thereof via the access opening 28. In this instance, there is formed between the webs 20*a*, 20*b* which together form the locking contour 19 at the opposite side a gap-like or slot-like unlocking opening 30, by means of which the locking bar 11 is accessible by means of a tool and can be manually pivoted into the unlocking position thereof shown in FIG. 3. If the plug type connection 10 is unlocked in this manner, the backrest 3 together with the backrest-side support member 9 can be released from the seat-support-side support member 8.

The invention is not limited to the embodiments described above. Instead, other variants of the invention may also be derived therefrom by the person skilled in the art without departing from the subject-matter of the invention. In particular, all the individual features described in connection with the embodiments can further also be combined in a different manner, without departing from the subject-matter of the invention.

Figure 8:
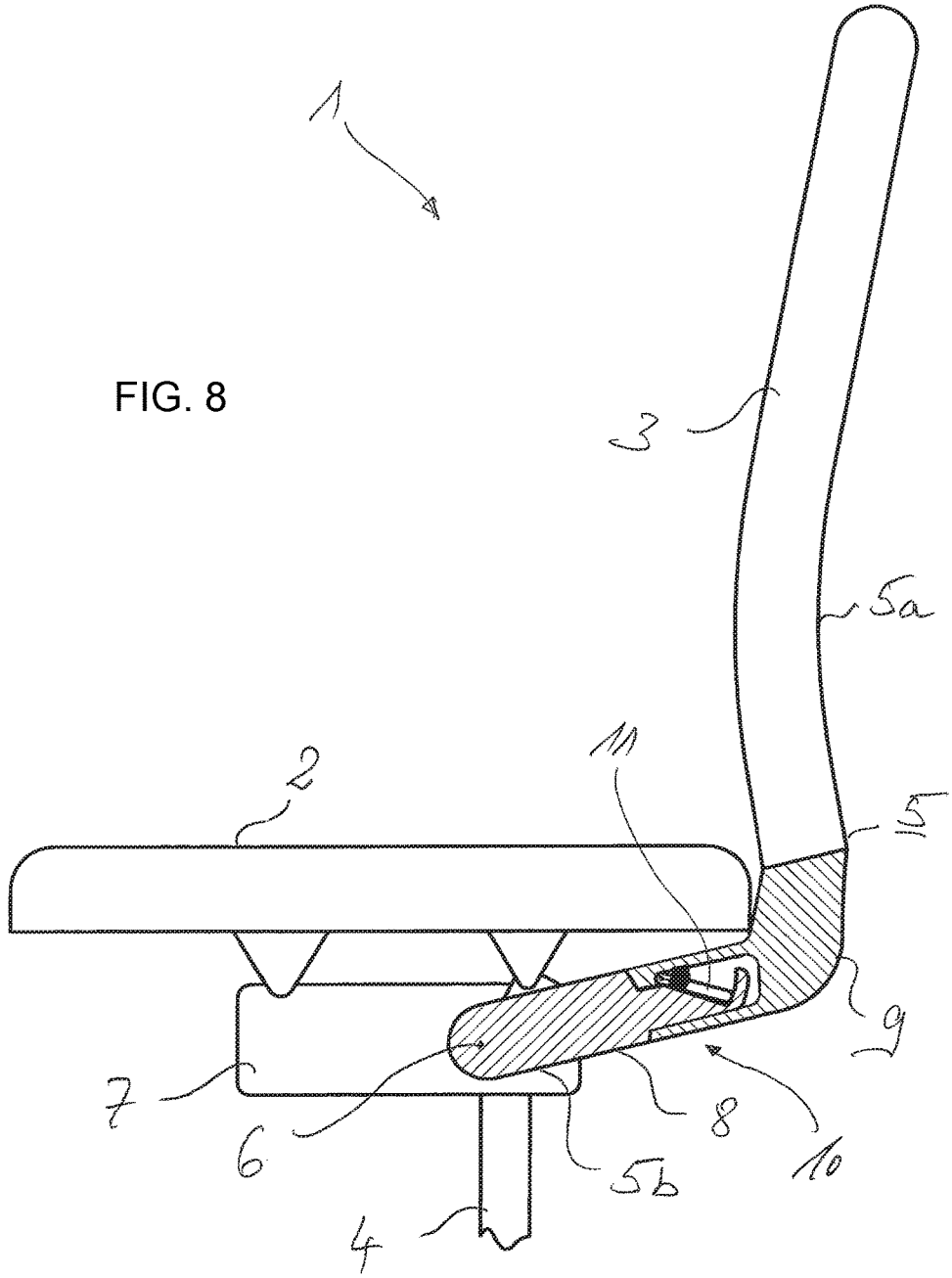
FIG. 8 is a schematic side view of an office chair according to FIG. 1 with a variant of the plug type connection with joined support members of the backrest support.

For example, according to the variant shown in FIG. 8, the plug type receiving member 12 may also be provided on the backrest-side support member 9 and accordingly the insertion shaft 19 may be provided on the seat-support-side support member 8.

In addition, the locking bar 11 may also be constructed as a locking hook which in the opposite insertion direction 21 with respect to FIG. 2 is shown so as to extend obliquely in the initial position thereof in order during the production of the plug type connection 10 to again be deflected against the inner wall 15 or against the insertion wall 17 of the plug type receiving member 12 and with corresponding insertion positioning to slide with the hook end thereof along the locking ramp 22 against the ramp base 23. The effect of the self-drawing of the insertion shaft 19 into the corresponding plug type receiving member 12 is thereby achieved again.

Figure 9:
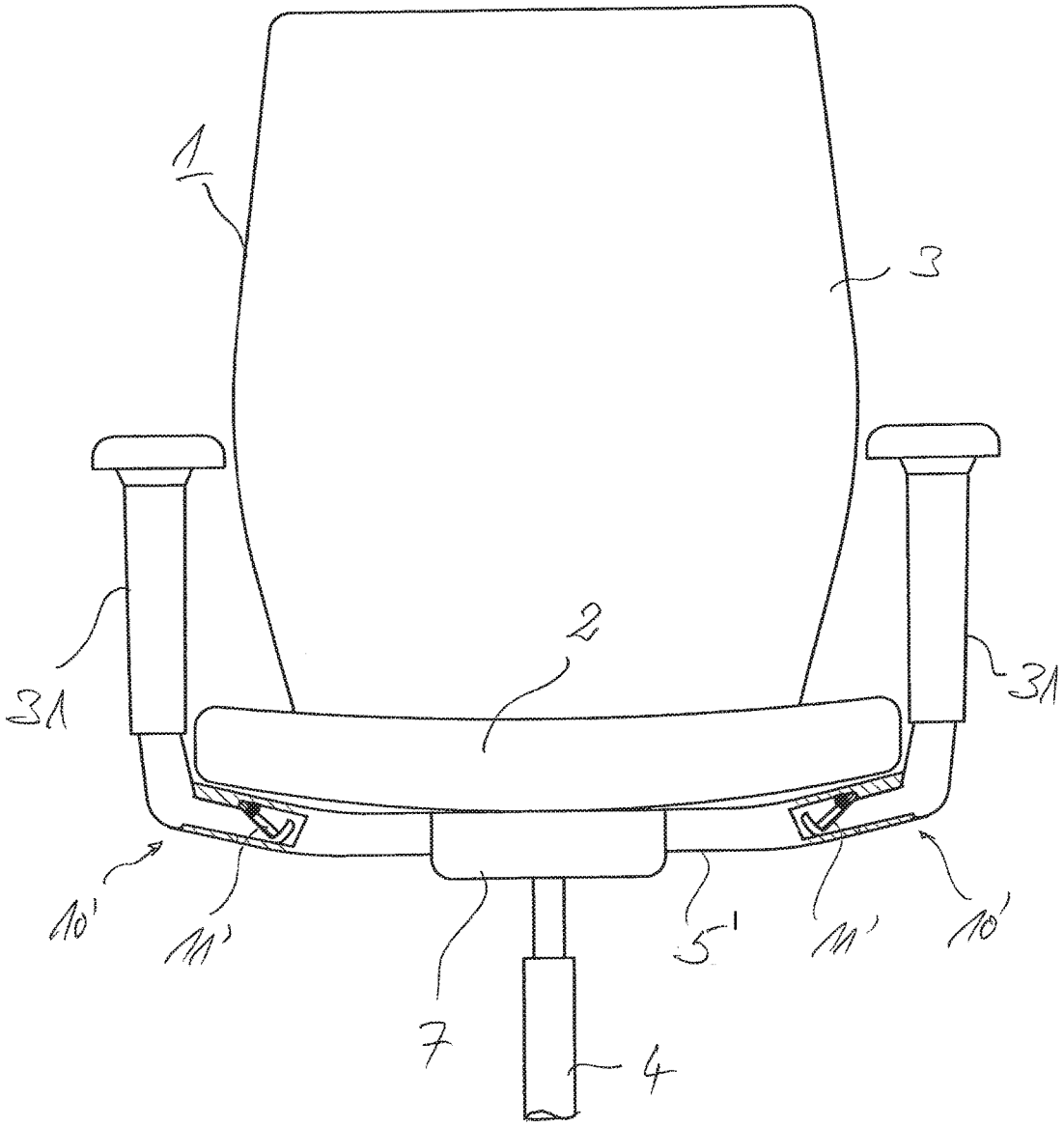
FIG. 9 is a front view of an office chair according to FIGS. 1 and 8 with armrests which are joined in corresponding plug type connections including locking.

Furthermore, with an office chair 1 which is provided according to FIG. 9 with armrests 31, these can also be mounted without any tools on the armrest support 5' with an identical plug type connection 10' including locking by means of a corresponding locking bar 11' which is preferably supported by means of a resilient element 14.

LIST OF REFERENCE NUMERALS

1 Chair/office chair
2 Seat face
3 Backrest
4 Chair column
5 Backrest support
5*a* Vertical L-shaped member
5*b* Horizontal L-shaped member
6 Rotary bearing

7 Seat support
8 Seat-support-side support member
9 Backrest-side support member
10 Plug type connection
11 Locking bar
12 Plug type receiving member
13 Rotary bearing
14 Resilient element
15 Inner wall
16 Stepped contour
17 Insertion wall
18 Insertion opening
19 Insertion shaft
20 Locking contour
20*a,b* Strut
21 Abutment ramp
22 Locking ramp
23 Ramp base
24 Outer contour
25 Ramp end
26 Free end
27 Formed element
28 Inner wall
29 Access opening
30 Unlocking opening
31 Armrest

The invention claimed is:

1. A chair, comprising:
a backrest;
a seat support;
a seat with a seat surface; and
a backrest support connecting said backrest to said seat support, said backrest support being constructed in two pieces including a seat-support-side, first support member associated with said seat support and a backrest-side, second support member associated with said backrest;
said first and second support members being joined to one another in a positive-locking plug connection and locked therein;
one of said first and second support members being formed, at a joint side thereof, with a plug type receiving member and the other of said first and second support members being formed, at a joint side thereof, with an insertion shaft;
a locking bar disposed inside said plug type receiving member, said locking bar being rotatably movable.

2. The chair according to claim 1, wherein said locking bar is pivotally mounted in an insertion direction.

3. The chair according to claim 1, which comprises a resilient element disposed inside said plug type receiving member, said resilient element being supported on an inner wall of said plug type receiving member and on said locking bar, and wherein said locking bar pivots counter to a restoring force of said resilient element during a closure of the plug type connection.

4. The chair according to claim 1, wherein said plug connection has an inner side with a recessed stepped contour into which said locking bar pivots during the plug type connection.

5. The chair according to claim 1, wherein said insertion shaft has a convex outer contour at a free end side thereof.

6. The chair according to claim 1, wherein said insertion shaft has a locking contour in which said locking bar pivots out during the plug type connection.

7. The chair according to claim 5, wherein a locking ramp is formed along said locking contour and said locking bar is disposed to slide along said locking ramp during the plug type connection with said free-end-side end face thereof sliding into said locking end position.

8. The chair according to claim 6, wherein an abutment ramp is formed along said locking contour, said abutment ramp running obliquely into a ramp base, and said locking bar pivots out against said ramp base during the locking operation.

9. The chair according to claim 6, wherein said locking contour is formed such that said locking bar, during a pivot movement thereof into the locking end position, draws said insertion shaft into said plug type receiving member in an insertion direction.

10. The chair according to claim 6, wherein said locking ramp is formed to conform to a pivot radius of said locking bar as a ramp depth increases.

11. The chair according to claim 1 being an office chair.

12. The chair according to claim 1, wherein said backrest is pivotally coupled to said seat support.

13. The chair according to claim 1, wherein said seat is coupled to said seat support for movement synchronously with said backrest.

14. A chair, comprising:
a backrest;
a seat support;
a seat with a seat surface;
an armrest; and
said armrest support being constructed in two pieces including a seat-support-side, first support member associated with said seat support and a backrest-side, second support member associated with said backrest;
said first and second support members being joined to one another in a positive-locking plug connection and locked therein;
one of said first and second support members being formed, at a joint side thereof, with a plug type receiving member and the other of said first and second support members being formed, at a joint side thereof, with an insertion shaft;
a locking bar disposed inside said plug type receiving member, said locking bar being rotatably movable.

15. The chair according to claim 14, wherein said backrest is pivotally coupled to said seat support.

16. The chair according to claim 14, wherein said seat is coupled to said seat support for movement synchronously with said backrest.

17. The chair according to claim 14 being an office chair.

* * * * *